United States Patent [19]

Ilott

[11] Patent Number: 4,798,336

[45] Date of Patent: Jan. 17, 1989

[54] CONTROL MEANS FOR SPRAYING APPARATUS

[76] Inventor: Jan Ilott, 24 Montague Hill, Kingsdown, Bristol, United Kingdom

[21] Appl. No.: 948,356

[22] PCT Filed: Mar. 27, 1986

[86] PCT No.: PCT/GB85/00186

§ 371 Date: Nov. 26, 1986

§ 102(e) Date: Nov. 26, 1986

[87] PCT Pub. No.: WO86/05718

PCT Pub. Date: Oct. 9, 1986

[30] Foreign Application Priority Data

Mar. 27, 1985 [GB] United Kingdom ..... 8507996

[51] Int. Cl.[4] ..... B05B 7/24; B05B 7/06

[52] U.S. Cl. ..... 239/337; 239/414; 137/626; 251/7; 251/294

[58] Field of Search ..... D23/17, 18; 239/77, 239/414, 415, 346, 337, 340; 251/294, 7, 9, 10; 137/636

[56] References Cited

U.S. PATENT DOCUMENTS

| | | | |
|---|---|---|---|
| 767,510 | 8/1904 | Wold | 239/414 |
| 1,268,403 | 6/1918 | Stacker | 239/415 |
| 1,272,752 | 7/1918 | Wold | 239/415 |
| 2,460,529 | 2/1949 | Paasche | 137/636 |
| 2,574,534 | 11/1951 | Curto | 137/636 |
| 4,161,289 | 7/1979 | Rebold | 239/414 |

*Primary Examiner*—Andres Kashnikow
*Assistant Examiner*—Chris Trainor
*Attorney, Agent, or Firm*—Hale and Dorr

[57] ABSTRACT

A control mechanism is provided for use in a gas-operated spraying apparatus such as an airbrush having a needle located axially of a nozzle, the needle being retractable in the nozzle to dispense a medium, for example, paint to be sprayed. The control mechanism includes a manually actuated operating member supported by a pivotal linkage and movable in a first manner to retract the needle, the pivotal linkage causing the needle to be retracted initially at a reduced rate.

16 Claims, 7 Drawing Sheets

Fig 4a
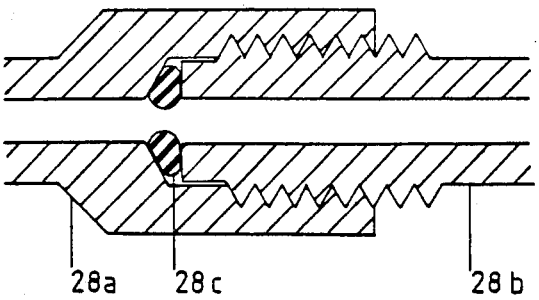
Fig 10a
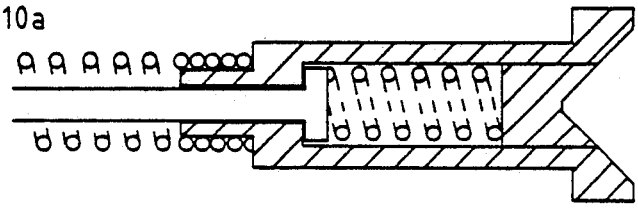
Fig 18
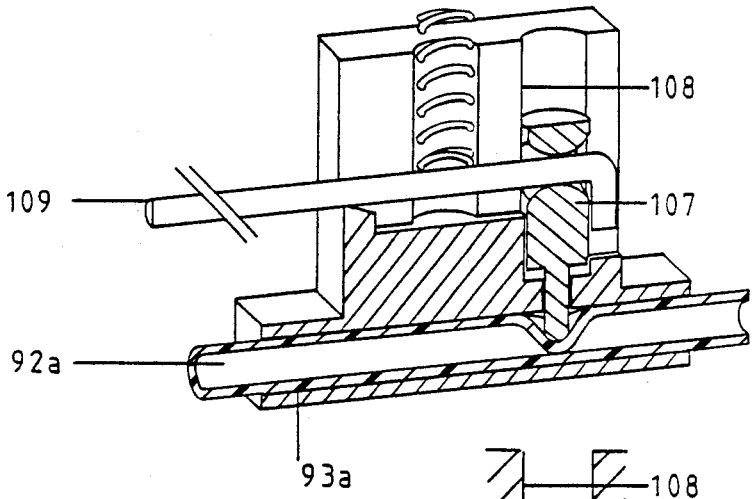
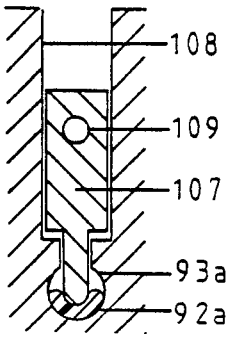
Fig 19

Fig 7
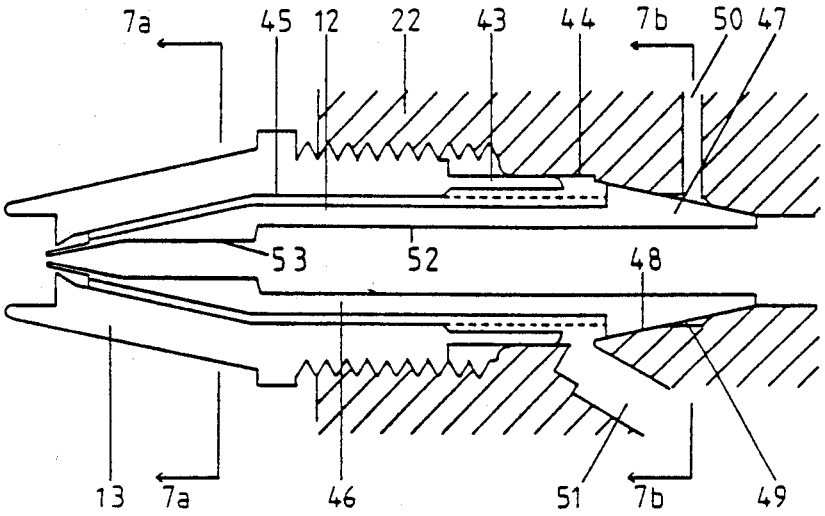
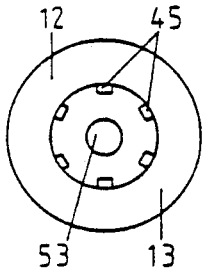
Fig.7a
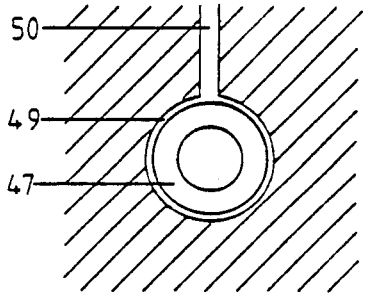
Fig 7b
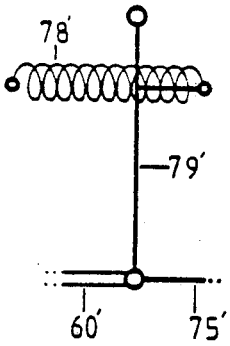
Fig 14b
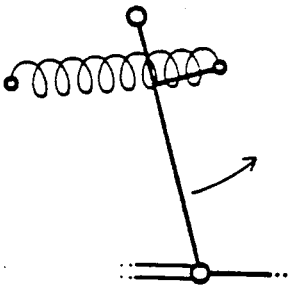
Fig 14c Fig 11
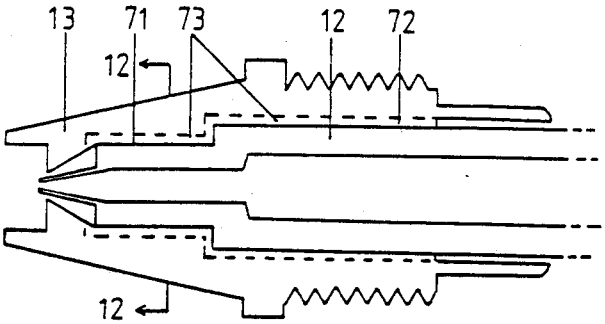
Fig 13
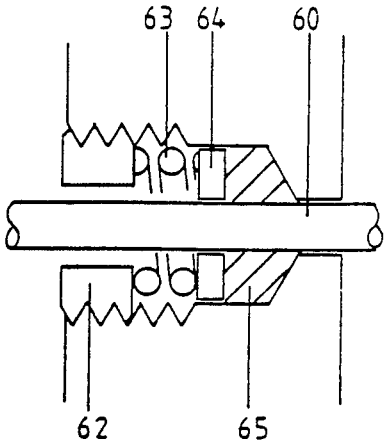
Fig 12
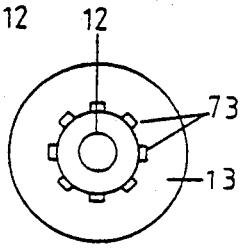
Fig 14
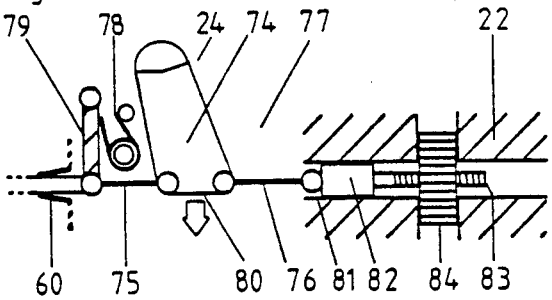
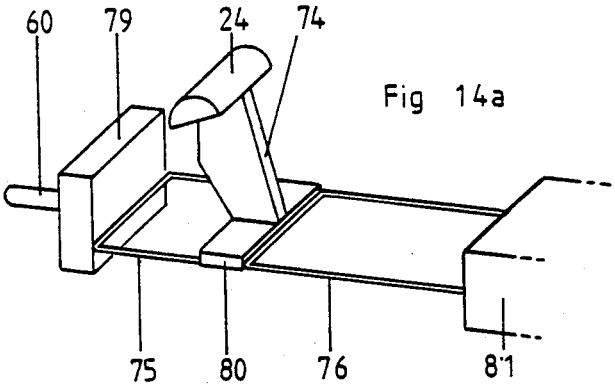
Fig 14a

CONTROL MEANS FOR SPRAYING APPARATUS

BACKGROUND OF THE INVENTION

This invention relates to spraying equipment operated by a gas such as air although other propellants, for example, Freon (trademark) are known. The invention relates particularly, but not exclusively, to airbrushes. Airbrushes are tools used by artists and illustrators for selectively spraying coloured dyes or pigments dissolved or dispersed in an aqueous or other liquid solvent or carrier to form inks, paints or similar media (hereinafter referred to as "paint" for the sake of convenience), and are used extensively in the preparation of advertisements and like commercial artwork, although such is the skill of exponents that airbrush work is now considered a fine art form.

A definitive work detailing the history, the construction and use of airbrushes is "The Airbrush Book" by Seng-gye Tombs Curtis and Christopher dunt published by Orbis Publishing Limited, London in 1980. This reference describes in detail the various types of airbrush past and present. As fine art tools, airbrushes are relatively delicate and, moreover, they are expensive. For example, conventionally, the nozzle and/or the needle (which control the release of paint) are made of brass or stainless steel. They are easily damaged in that, to provide a different sized nozzle, to replace a damaged nozzle or needle or for cleaning purposes, the airbrush must be disassembled, cleaned and reassembled. During reassembly, the needle must be inserted into the nozzle to exactly the correct extent to ensure a seal and to avoid damaging the nozzle.

FIG. 1 is a diagrammatic fragmentary cross-section of a known nozzle/needle combination.

The needle 10 has a tip of substantially conical shape sealingly fitting into a nozzle 12. The aperture in the nozzle 12 may be, for example, 0.2 mm. The diameter of the needle may taper from 1.5 mm to a point.

The angle of taper is small so that, upon retraction of the needle, a large movement is necessary to give an appreciable change in the flow of paint. This is desirable so as to give greater control of paint flow. However, if the angle of taper of the needle is too small, the mechanical advantage is such that on moving to the closed position, the needle tip 11 tends, in use, permanently to spread the nozzle opening. The sealing may be reduced but also the airbrush no longer has the required control characteristics in the dispensation of paint. If the needle is bent, the paint will not flow evenly. If the nozzle is bent or distorted, it will not locate concentrically with the needle or a surrounding air cap 13 and the air flow through the annulus between the nozzle and the air cap will be uneven. Uneven flow of paint or of air gives rise variously to spatter or spitting. In an extreme case, of course, the nozzle 12 may well be split or cracked by the needle tip 11.

The needle and the nozzle are both relatively expensive items to replace but the errors produced due to these faults and the time lost in replacement or cleaning can be more expensive.

Other forms of spraying equipment utilize concentric needle, nozzle and air cap arrangements and, to varying extents, suffer from the disadvantages above ascribed to airbrushes. The present invention relates equally to such spraying equipment.

The nozzle and the needle/nozzle unit described hereinafter form the subject matter of my copending patent application Ser. No. 06/948,357 filed simultaneously herewith and claiming priority from my UK patent application No. 8507966 filed Mar. 27, 1985.

"Double independent control" of air and paint is provided by a single operating member in most high class commercially available airbrushes. The operating member is depressed to increase the flow of air and is moved in a second substantially perpendicular direction, usually rearwardly, to control the retraction of the needle and thereby the flow of paint.

FIG. 2 of the accompanying drawings is a fragmentary diagrammatic sketch of a prior art airbrush air and needle control means.

A manually operated control means comprises a button 14 depressable to move a rod 15 pivotally connected thereto whereby progressively to open an air valve (not shown). The rod slides in an aperture of the body member 17. The button stem 16 is bifurcated to straddle the needle 10. The body member 17 provides a fulcrum 18 whereabout a lever 19 may pivot. The lever 19 engages a needle support 20 and thereafter is curved forwardly to form a sliding engagement with the stem 16. Pivotal movement of the stem 16 in a clockwise direction (as seen in the drawings) pivots the lever 19 about its fulcrum and urges the needle support 20 and hence the needle 10 to the right. The needle is thereby retracted in the nozzle (not shown) to dispense the paint. The arrangement constitutes an approximately 1:4 linkage and the movement of the needle 10 corresponds substantially linearly to that of the button 14. Such movement does not give rise to the desired initial finest control mentioned above.

In my copending application Ser. No. 06/948,357 filed simultaneously herewith, the problems arising from the limitations of the nozzles are solved. Maximum advantage of this solution can only be achieved, however, if the control of the dispensation of both air and paint is also optimised. Thus, for finest control, it is essential that at least the initial movement of the needle, upon retraction, be effected with the utmost accuracy and precision.

An object of the present invention is the provision of an improved control means for a gas-operated spraying apparatus wherein the aforesaid optimisation is realized.

SUMMARY OF THE INVENTION

According to the present invention, there is provided a gas-operated spraying apparatus comprising a needle located coaxially of a nozzle and retractable in the nozzle to dispense media to be sprayed, an operating member movable to effect retraction of the needle and coupling means coupling movement of the operating member to the needle in a non-linear manner, characterized in that the coupling means comprises a suspension linkage pivotally translating the movement of the operating member to the needle.

The coupling means may include a lever system which translates arcuate movement of the operating member into linear movement of the needle at a reduced rate.

The suspension linkage preferably operates in tension.

A plunger, spring-biased into contact with the needle, may serve to transmit movement of the operating member and consequent movement of the coupling means to the needle.

In one arrangement, the control means is arranged to increase the ratio of gas-to-medium flow as the operating member is moved to increase the flow of medium. Conveniently, the operating member is movable in a first direction to control the flow of gas and in a second direction to control the flow of medium. The axes of movement are preferably offset relative to each other whereby operation of the member to control the flow of gas is dependent upon the instantaneous position of the member in controlling the flow of medium.

The spraying apparatus may be in the form of an airbrush with a body having a transverse through hole communicating with a feed passage in the body for medium to be sprayed, either or both ends being sealable with a plug.

The transverse through hole is advantageously offset from and transverse to the location of the needle in the airbrush.

The plug may be constituted by a shuttle valve retained in the through hole and movable axially therein to seal either or both ends thereof.

A media cup may be provided, the cup having a feed pipe extending therefrom and having an aperture adjacent the end of the pipe arranged to register with the feed passage when the media cup is mounted to the airbrush by inserting the pipe from either end into the transverse through hole in the body.

Advantageously, the feed passage, at one end, communicates with the interior of a nozzle and the transverse through hole and, at the other end, with a sealable socket in the end of body remote from the nozzle whereto a medium supply pipe may connect.

The airbrush may have a socket whereto an air feed may be connected at that end of the airbrush body remote from the nozzle.

The air and medium sockets in the end of the airbrush body may be coaxial.

The airbrush body is preferably symmetrical about its longitudinal vertical mid-plane, the width being less than the height of the body. The nozzle may be offset from the centre line towards the lower part of the body.

Figure 3:
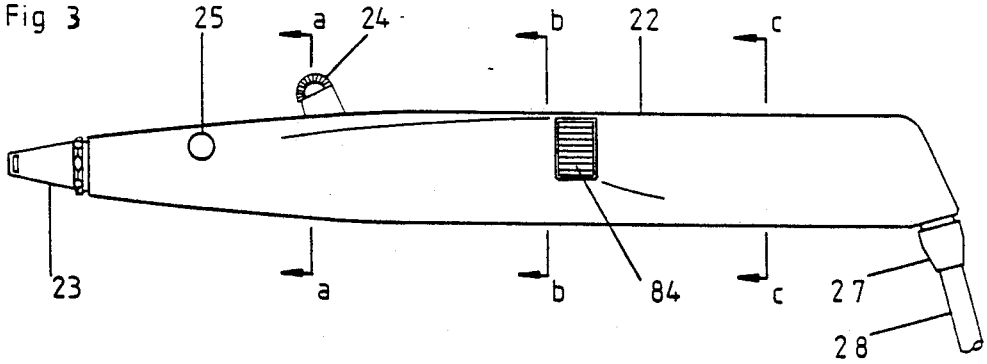
Figure 3A:
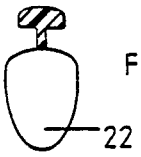
Figure 3B:
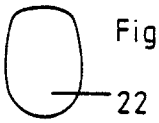
Figure 3C:
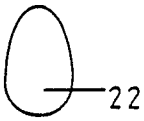
Figure 4:
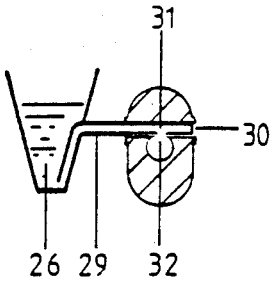
Figure 5:
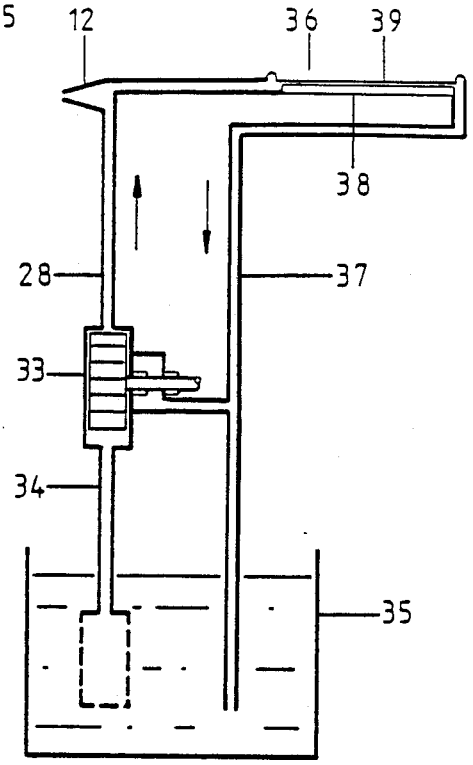
Figure 6:
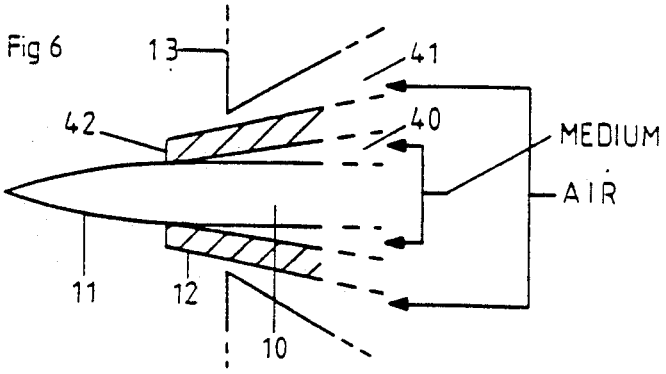
Figure 8:
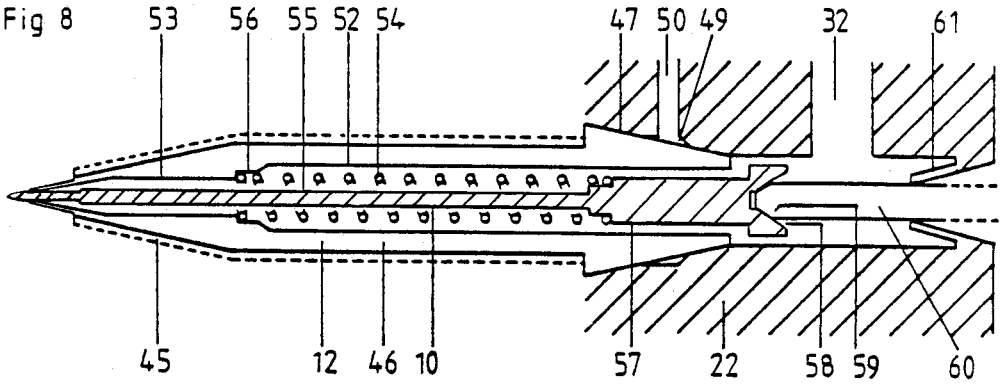
Figure 9:
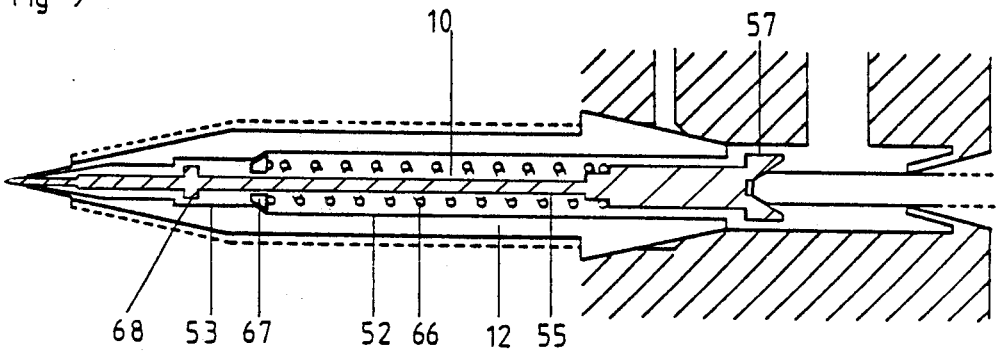
Figure 10:
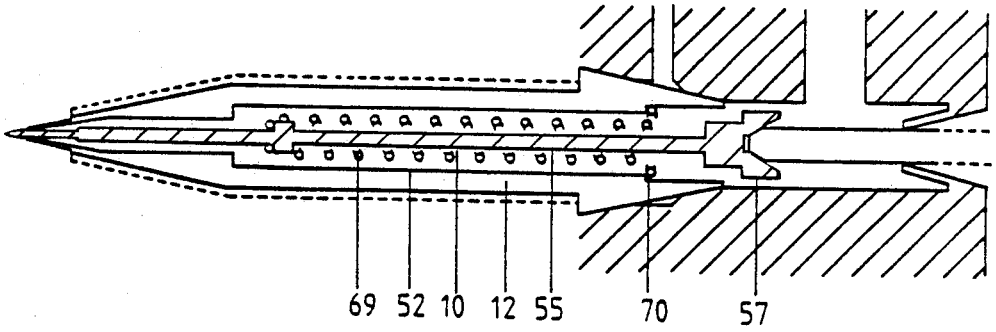
Figure 16:
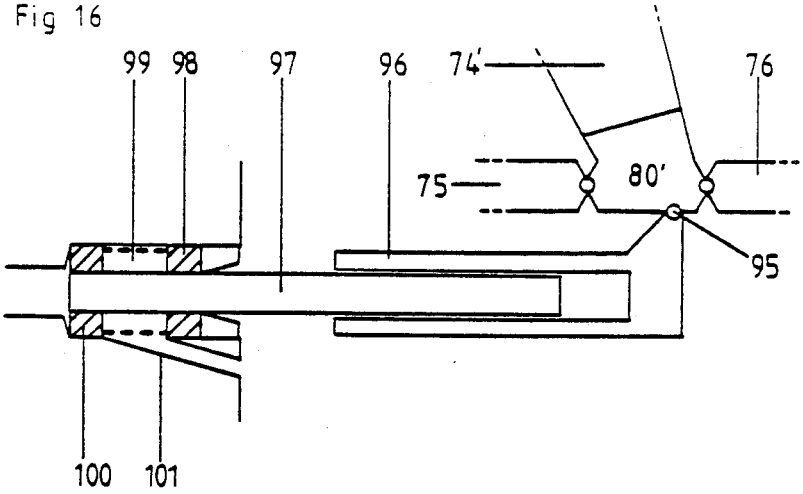
Figure 17:
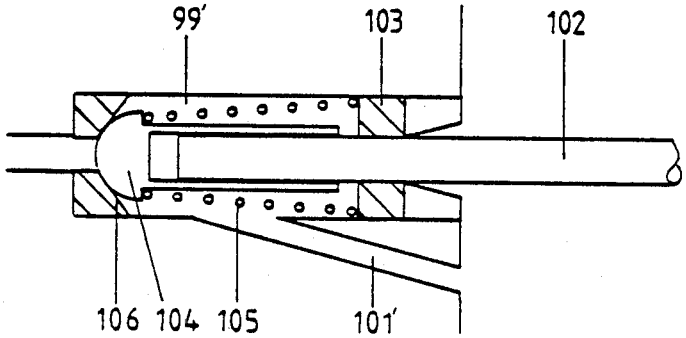
Figure 15:
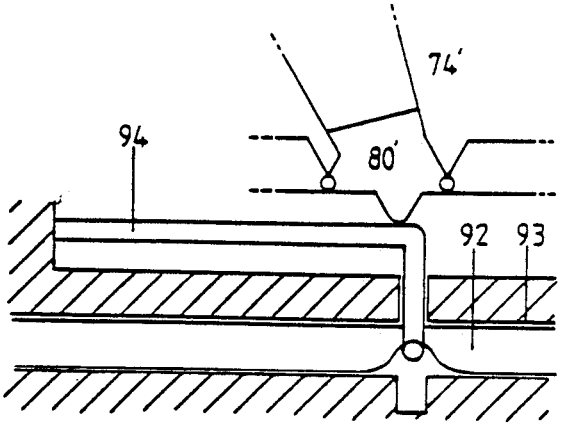

The invention will be described further, by way of example, with reference to FIGS. 3 to 18 of the accompanying drawings, in which:

FIG. 3 is side elevation of a preferred form of airbrush incorporating the control means of this invention;

FIGS. 3*a*, 3*b* and 3*c* indicate the detached transverse sectional shape of the airbrush on the lines a—a, b—b and c—c respectively;

FIG. 4 is a diagrammatic cross-sectional view of one form of side mounted paint cup and its manner of connection to the airbrush of FIG. 3;

FIG. 4*a* is a sketch in cross-section of an airline coupling for an airbrush incorporating an obturating valve;

FIG. 5 is a diagrammatic sketch of a pumped means for supplying paint at constant pressure to an airbrush;

FIG. 6 is a fragmentary section of a nozzle tip and needle;

FIG. 7 is a vertical cross-sectional view of the nozzle end of an airbrush, showing a preferred nozzle;

FIGS. 7*a* and 7*b* are detached cross-sections taken on the lines 7*a*—7*a* and 7*b*—7*b* of FIG. 7;

FIG. 8 is a vertical section, corresponding in part to FIG. 7, but showing also a needle and its operating plunger;

FIGS. 9 and 10 illustrate modified forms of the needle shown in FIG. 8;

FIG. 10*a* illustrates a modified form of head of a needle which may be used in any of the embodiments of needles described herein;

FIG. 11 illustrates diagrammatically a modified form of nozzle and air cap of an airbrush;

FIG. 12 is a detached cross-section taken on the line 12—12 of FIG. 11;

FIG. 13 illustrates an alternative manner of sealing a needle operating plunger in the body of an airbrush;

FIG. 14 is a diagrammatic sketch of a novel operating member and its associated mechanism, according to the invention;

FIG. 14*a* is a perspective view of the operating member shown in FIG. 14;

FIG. 14*b* and FIG. 14*c* are diagrammatic sketches of a preferred biasing arrangement of the operating member of FIG. 14;

FIG. 15 is a diagrammatic sketch of an alternative air flow control arrangement;

FIG. 16 is a diagrammatic view of a further air control arrangement;

FIG. 17 is a partial diagrammatic view of a modification of the air control arrangement shown in FIG. 16; and FIGS. 18 and 19 are respectively longitudinal and transverse fragmentary cross-sectional diagrams of a preferred air control valve.

DESCRIPTION OF THE PREFERRED EMBODIMENT

As shown in FIG. 3 of the drawings, an airbrush incorporating the control means of the present invention is itself of novel shape. The airbrush comprises a body 22 preferably moulded from a plastics material of lightweight but high strength. The body 22 is symmetrical about its vertical longitudinal midplane as indicated by the cross-section sketches in FIGS. 3*a*, 3*b* and 3*c*. The body 22 has an air cap 23 which locates the nozzle and needle assembly (described below) in the body, an operating member 24 for controlling the feed of air and medium to the nozzle, and a transverse through hole 25 for receiving a medium cup 26 (FIG. 4) or a blanking plug or plugs when a pressurized medium feed is used. Alternatively, a shuttle valve (not shown) may be located in the through hole 25 and movable axially to seal either end of the hole or to an intermediate position to seal both. The body 22 also has an air or an air and medium connector 27 whereby air or air and medium to be sprayed may be fed to the airbrush, via a connecting pipe 28. The sockets for connector 27 and the pipes 28 thereto may be coaxial or side by side. As shown in FIG. 4*a*, the coupling between the airline and the airbrush comprises two axially-bored screw-threaded relatively rotatable members sandwiching therebetween a soft resilient O-ring. Screwing of the male member into the female member causes the O-ring to be deformed obturating the axial passage. In this way, a throttle valve is incorporated into the airline permitting the maximum airflow to be preset. However, it is envisaged that at least the airline connecting pipe 28 will be couplable to the airbrush by some quick-release coupling, for example, a bayonet coupling. The arrangement shown in FIG. 4*a* could be formed in one half of such a coupling. Alternatively, a supply line (not shown) for medium, which may be pressurized, may be plugged into the transverse through hole 25.

If the medium to be applied by the airbrush is supplied in the side mounted cup 26, the cup has a radially extending feed pipe 29 shaped so as to draw medium from the bottom of the cup 26. The pipe 29 has an aperture 31 adjacent the end 30 arranged to communicate, when inserted from either end, as desired, into the through hole 25, with a longitudinal medium feed passage 32 in the body 22. To this end, upon insertion of the feed pipe into the transverse through hole 25, the shuttle valve, if one is provided, is moved to seal the other end of the hole. The feed pipe 29 or the end of a medium supply line is shaped to permit the flow of medium when in abutting relationship with the shuttle valve.

If the medium to be sprayed is to be fed by pressure to the airbrush, it is advantageous that the pressure of the medium at the airbrush is maintained constant. FIG. 5 diagrammatically illustrates a constant pressure medium pumping device in which a pump 33 (shown here as a self-priming pump although other types of pump may be used) feeds the medium to be applied via a filtered inlet pipe 34, from a reservoir 35 and the pipe 28 to the airbrush. The medium is fed to the nozzle 12 (shown diagrammatically) and surplus returns therefrom through a constant pressure valve 36 via a return pipe 37 to the reservoir 35.

If the pump 33 is of the self-priming type, it is advantageous that some means of de-activating the self-priming be provided otherwise, as the reservoir 35 empties, air may be drawn through the pipe 28 to the airbrush. If a non-self-priming pump is used, its dimensions should be such that it can be received in a small container.

The constant pressure valve 36 is preferably located in the airbrush so that it operates at the same head pressure as the medium supplied to the nozzle. The valve comprises a flat plate 38 whereover a thin flexible membrane 39 is peripherally secured so as to form a medium passage therebetween. The membrane 39 acts as a false surface layer and medium can only pass therethrough when the pressure of the medium on the membrane 39 is equal to or greater than ambient pressure.

Shaft leakage of medium from the pump 33 can be returned via the return pipe 37 to the reservoir 35.

Referring now to FIGS. 6 to 13 of the drawings, novel features of the needle 10, nozzle 12, and air cap 13 will be described. The nozzle 12 is described in more detail and claimed in my aforesaid copending application Ser. No. 06/948,357. The nozzle 12 is a one piece injection moulding of a plastics material resistant to the media it is likely to encounter, has a high dimensional stability, good fatigue resistance and a high elongation before break. The needle 10 may be of a metal such as stainless steel or tungsten.

The nozzle 12 presents, at its forward end, a frustro-conical shape defining, with the needle in its rest position, a seal for a substantially annular medium flow passage 40 preventing the escape of medium. The needle 10 has a tip 11 of varying taper, the taper being greatest adjacent the point and lessening towards the region whereat it forms a seal with the nozzle. In this region, the diameter of the needle tip 11 is only slightly greater than the diameter of the aperture in the nozzle whereby the latter is expanded by engagement with the needle when the needle is in its rest position. As the needle is withdrawn (moved to the right in the drawings) due to its shallow taper and due to the memory of the plastics material of the nozzle, excellent control of the dispensation of medium through the annular passage 40 therebetween is achieved due to the greater movement of needle necessary to produce an appropriate change in the quantity of medium dispensed.

The nozzle 12 locates substantially concentrically within an air cap 13 and defines therewith an annular passage 41 for the flow of air. The frustro-conical shape of the nozzle 12 presents an annular land 42 which enhances turbulent flow in the air stream to "atomise" medium on the tip 11 of the needle 10.

As can be seen in FIG. 7, the air cap 13 serves to locate the nozzle 12 in the body 22 of the airbrush, being a screw fit into a threaded socket in the front end of the airbrush. The air cap 13 has a skirt 43 which may be flexible, arranged to fit sealingly into an appropriately dimensioned bore 44 in the body 22. Internally, the air cap 13 is shaped to receive the frustro-conical shaped nozzle 12 and defines therewith narrow air passages 45 (FIG. 7*a*) either in the surface of the nozzle 12 or internally of the cap 13.

The nozzle 12 has a hollow central cylindrical portion 46 having the frustro-conical shape at its forward end and a tapered hollow plug 47 at its rear end. The plug 47 is a compression fit into a similarly tapered recess 48 in the body 22. An air vent ring 49 is provided in the surface of the plug 47 (FIG. 7*b*) or the recess 48 (FIG. 7) and an air vent 50 leads therefrom to the exterior of the body 22.

Air is supplied via a passage 51 in the body 22 to the space between the central cylindrical portion 46 of the nozzle 12 and the skirt 43 of the air cap 13.

The nozzle 12 has a first diameter bore 52 extending from the rear to adjacent the frustro-conical portion and a second lesser diameter bore 53. The needle 10 is located in these bores as shown in FIG. 8. A spring 54 surrounds the needle. The spring 54 or the needle 10 may be coated with a release agent to prevent binding but, preferably, the spring floats clear of the internal surface of the bore 52 and the surface of the needle stem 55. The spring 54 abuts at its forward end against the shoulder defined by the change in diameter between the first and second bores 52 and 53. It is preferred however to provide a stepped shoulder 56 which may be tapered at this point so as to locate the forward end of the spring 54. The other end of the spring engages a head 57 of the needle 10 and is pre-compressed so as to bias the needle to the right (as shown in the drawings). The head 57 of the needle has a self-centering recess 58 wherein an end 59 of an operating plunger 60 locates. A passage for the flow of medium to be applied extends from the feed passage 32, around the head 57 of the needle and through the first and second diameter bores of the nozzle to the tip 11 of the needle. In most embodiments, the needle head, particularly the modified head shown in FIG. 10*a*, ensures that this range is not exceeded even when the needle tip has a relatively steep taper and the plunger cooperates with the needle to define a sealing position of the needle intermediate the extremes of the range. A passage for the flow of paint to be applied extends from the feed passage 32, around the head 57 of the needle and through the first and second diameter bores of the nozzle to the tip 11 of the needle.

The plunger 60 may be sealed in the body by a pressure operated skirt 61 as shown in FIG. 8. Alternatively, as shown in FIG. 13, a stuffing box seal comprising a screw 62, spring 63, washer 64 and packing material 65 such as P.T.F.E. tape may seal the plunger 60 into the body 22 against the ingress of medium. In yet another embodiment (not shown), the plunger may be sealed to the body by a diaphragm whereby to avoid sliding surfaces.

As can be seen from FIG. 9, the needle 10 may be provided with a pre-compressed spring 66 held in position on the needle stem 55 by a washer 67 and obturation 68 whereby to ensure a bias on the needle independent of the extent of insertion of the needle 10 into the nozzle 12.

Alternatively, and as shown diagrammatically in FIG. 10, an extension spring 69 secured to the needle stem 55 or having reduced diameter portion locating on a shoulder thereof and at the other end locating on shoulder 70 of the nozzle 12 may serve to bias the needle toward its retracted position. The extension spring 69 should have a high initial tension.

FIG. 11 shows an alternative method of locating the nozzle 12 in the air cap 13. In this embodiment, the nozzle 12 has rearwardly of its frustro-conical portion, a first diameter cylindrical portion 72. Either or both portions may be interference fits within corresponding bore portions of the air cap 13. Narrow air passages 73 are provided longitudinally and in the surface of the cylindrical portions of the nozzle 12 or of the corresponding bore portions of the air cap 13.

In another embodiment (not shown), the nozzle is a screw fit within the air cap to prevent rotation or other movement of the nozzle relative to the air cap. This arrangement also permits accurate location of the needle relative to the nozzle and to air cap. The air cap may then be screwed or otherwise located in the airbrush body to determine the end position of the needle. Yet another method of preventing the nozzle from rotating in the air cap is to provide the cylindrical or conical portion of the nozzle with a polygonal cross-section. The internal surface of the mating section of the air cap is correspondingly shaped, air passages 45 being provided, as previously described, in the surface of the nozzle or in the air cap.

A gas-operated spraying apparatus, for example, the novel airbrush has a control means according to the invention and a first embodiment of this is shown diagrammatically in FIGS. 14 and 14*a*. As mentioned above, greatest control is required by an operator when least medium is being dispensed. It is preferred that any movement of the needle, initially should be caused by a magnified movement of operating member 24 i.e. movement of the needle should be some reduced function of movement of the operating member 24. For example, arcuate movement of the operating member 24 may cause movement of the needle 12 in dependance at least initially upon the square of the angle of the arcuate movement.

As shown in FIGS. 14 and 14*a*, the operating member 24 comprises a control lever 74 suspended by pivotal links 75, 76 in a slot 77 in the body 22 of the airbrush. The needle operating plunger 60 is slidably located in the body 22 and is urged by a spring 78 acting on a lever 79 pivotally connected to the plunger 60, to the left as seen in FIG. 14 to bias the needle to its sealing position in the nozzle.

Figure 1:
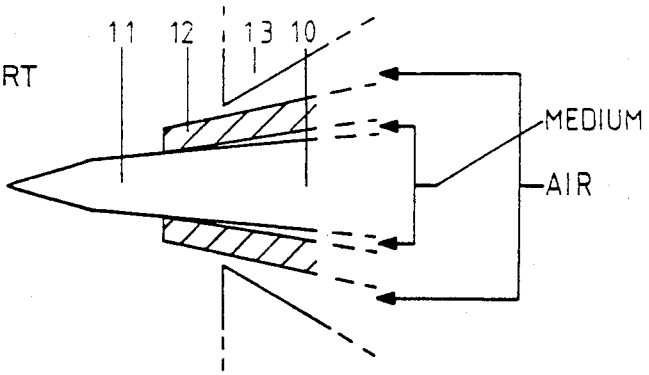
Fig 1 PRIOR ART
FIGS. 1 and 2 as above described illustrate a known nozzle/needle combination and a control mechanism.
Figure 2:
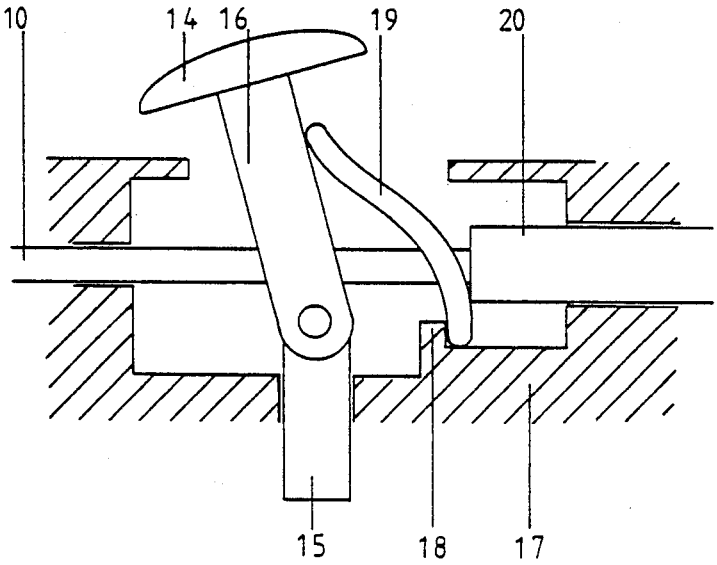
Fig 2 PRIOR ART

The lever 79 also pivotally connects to the suspension link 75 which, in turn, pivotally connects an edge of a plate 80 supporting the control lever 74. At an opposite edge of the plate 80, the link 76 pivotally connects the plate 80 with an adjustable stop 81 formed by a manually-rotatable captive nut 84 in the body 22 of the airbrush. The stop 81 defines the rest (sealing) position of the needle 10. The control lever 74 can be depressed (see FIG. 2) to operate an air valve (not shown).

Such movement has little effect on the dispensation of medium as the movement of the needle occasioned thereby is insufficient to open the annular passage between the needle tip 11 and the nozzle 12. However, if desired, appropriate adjustment of the captive nut 84 permits dispensation of medium merely upon depression of the control lever 74. Alternatively, some lost motion may be provided to prevent rearward movement of the plunger 60, and hence of the needle. If the control lever 74 is moved rearwardly, its suspension ensures that a reduced motion is transferred via the linkage to the plunger 60 to move the latter to the right, as seen in the drawings, and thereby permit corresponding movement of the needle 10 under the action of its spring.

It will be appreciated that the links 75, 76 operate only in tension and could therefore be replaced by cords, wires or the like.

FIGS. 14*b* and 14*c* illustrate an alternative method of biasing the control member during dispensation of medium. A spring 78′ is attached to the airbrush body and to an arm of a lever 79′ pivotally attached at one end to the airbrush body and, at its other end, to the pivotal connection between the plunger 60′ and the links 75′. Such a biasing arrangement can be arranged to operate at a substantially constant force irrespective of the position of the control member.

In accordance with desirable further features of an airbrush as described herein, control of the air supply to the nozzle can be enhanced.

Referring to FIG. 15, a very simple air control valve is shown in which air is ducted along a flexible tube 92 constrained by a duct 93 in the body of the airbrush. A spring 94 is mounted in the body and is biased upwardly as shown. The spring locates under the tube 92 at a break in the duct 93 and, by its bias, pinches the tube upwardly. The spring 94 can be moved downwardly, out of engagement with the tube 92, by corresponding movement of a control lever 74′ similar to the control lever described in relation to FIG. 14.

FIG. 16 shows a further form of air control in which, additionally, the control of air is dependent upon the instantaneous position of the control member in controlling the flow of medium. In the arrangement described in relation to FIG. 14, it was indicated that the control lever 74 was moved downwardly (as indicated by the arrow in that Figure) to increase the flow of air. The arrow is shown positioned at what is the point of natural rotation of the linkage 75, 80, 76. Movement of the lever 74 downwardly thus has no effect on movement of the plunger 60 controlling dispensation of the medium to be sprayed. It may be desirable, in fact, to allow the instantaneous position of the lever 74, in dispensing medium, to have an effect on the control of the rate of dispensation of air and/or vice versa. This can be achieved, in FIG. 14, by having the point of contact of the lever 74 away from the natural point of pivotal movement of the linkage 75, 80, 76.

In FIG. 16, such an arrangement is shown albeit utilising a modified air valve. The lower element 80′ of the control lever 74′ is part of a linkage 75′, 80′, 76′. The element 80′ is, in this case, a one piece moulding integral with the lever 74′ and integrally connected through a moulded hinge 95 with a member 96 telescopically containing a second member 97. The member 97 extends through a first seal 98 into and through an air chamber 99 and into engagement with a resiliently deformable seal 100. Air is fed to the chamber 99 through a passage 101. Pivotal movement of the second member 97 about the first seal 98, occasioned by corresponding movement of the control lever 74' downwardly, causes deformation of the resiliently deformable seal 100 permitting air to escape therepast and to the air cap of the airbrush. It will be appreciated that the hinge 95 can be located as desired along the linkage 75, 80', 76 during design, to achieve the effect of enhanced air dispensation. Other arrangements are possible, of course, with the embodiments described in FIGS. 14, 15, 16 and 17, in which the point of operation (for example, constituted by the hinge 95 in FIG. 16) can be adjustable along the linkage i.e. the element 80' in FIG. 16.

FIG. 17 shows a modified form of air valve which can be incorporated in the arrangement of FIG. 16. In this embodiment, a piston-like member 102 is connected to the control lever (not shown) and is pivotally and/or slidably mounted in a seal 103. The end of the member 102 is telescopically located in a mushroom-headed valve 104 urged by a spring 105 onto a conical seat 106. Pivotal movement of the member 102 displaces the valve 104 from the seat 106 allowing air to be fed via the passage 101' and the chamber 99' to the air cap (not shown) of the airbrush.

FIGS. 18 and 19 show a preferred form of air valve somewhat similar to that shown in FIG. 15. A resilient tube **92*a* is connectable to an air supply (not shown) and locates in a elongate recess 93*a* in the airbrush body. The tube 92*a* is nipped by a valve member 107 vertically slidable in a slot 108 in the body. The position of the valve member is controlled by a pivotal lever 109 spring biased to urge the valve member to nip the tube 92*a*. Depression of that end of the lever remote from the valve member against the spring bias, moves the valve member upwardly to free the tube and permit the flow of air to the airbrush nozzle. Such depression is effected, for example, by the element 80 or 80'** of the above described linkage.

The invention, with its several features, may be applied to existing airbrushes or other micro-spraying or spraying equipment or to novel airbrushes, for example, as shown in FIG. 3. It will be appreciated that many variations are possible of the integers described herein, and the description and drawings hereof are not to be considered in any way limitative thereof.

I claim:

1. In a gas-operated spraying apparatus having a body, a nozzle mounted at a forward end of said body, a needle located coaxially of said nozzle, said needle being retractable in said nozzle to dispense media to be sprayed, medium feed means and propellant feed means, an operating member, and control means manipulated by said operating member for controlling the retraction of said needle and hence of the dispensation of the medium to be sprayed, the improvement wherein said control means comprises:- coupling means supporting said operating member, said coupling means comprising a first support member wherefrom said operating member is pivotally suspended at a first location, and a second movable, support member, said second support member serving, on movement in a first direction, to effect retraction of said needle, said operating member being pivotally suspended from said second support member at a second location spaced from said first location, whereby said operating member is in suspension between said first and second support members, said suspension permitting both arcuate movement of said operating member to move said second support member in said first direction to retract said needle, and linear movement of said operating member perpendicular to the axis of said needle, in which movement of said second support member is minimized.

2. Control means for spraying apparatus, particularly a gas-operated spraying apparatus arranged to spray a medium such as paint using a gas such as air as a propellant, said apparatus comprising a nozzle, a needle located coaxially of said nozzle, said needle being retractable in said nozzle to dispense media to be sprayed, said control means comprising an operating member, said operating member being movable to effect said retraction of said needle, and coupling means supporting said operating member, said coupling means comprising a first support member wherefrom said operating member is pivotally suspended at a first location, and a second movable, support member, said second support member serving, on movement in a first direction, to effect retraction of said needle, said operating member being pivotally suspended from said second support member at a second location spaced from said first location, whereby said operating member is in suspension between said first and second support members, said suspension permitting both arcuate movement of said operating member to move said second support support member in said first direction to retract said needle, and linear movement of said operating member perpendicular to said first direction, in which movement of said second support member is minimized.

3. Control means according to claim 2 wherein said operating member comprises an upstanding, manually accessible lever and a base member having rear and front ends said spaced first and second locations being located respectively at said rear and front ends, said arcuate movement of said operating member being centered on said first location and being arranged so that said coupling means provides a leverage which translates said arcuate movement into linear sliding movement of said second support member, and hence of said needle, at a reduced but increasing rate.

4. Control means according to claim 2 including a first link whereby said operating member is pivotally suspended from said first support member, a second link whereby said operating member is pivotally suspended from said second support member, and a third member connecting said second support member to said second link, to allow for movement of said second support member substantially coaxial with said needle.

5. Control means according to claim 4 wherein said first and second links and said third member serve to support said operating member as a suspension linkage operating only in tension.

6. Control means according to claim 2 wherein said second support member comprises a plunger and further including spring means for urging said plunger into contact with said needle to transmit movement of said operating member to the needle.

7. Control means according to claim 6 further including plunger sealing means for preventing, in use, ingress of medium to said control means.

8. Control means according to claim 2 including a gas valve, said linear movement of said operating member serving to actuate said gas valve.

9. Control means according to claim 8 wherein said operating member has a rest position from where it may be pivoted and from where it may be depressed linearly, said suspension of said operating member being arranged, in pivoted positions of said operating member, to increase the effect of said linear movement in actuating said gas valve.

10. Control means according to claim 2 further including adjustment means, said adjustment means cooperating with said first support member to define a fixed position of said first support member.

11. Control means according to claim 9 comprising a first axis coincident with said first location whereabout said operating member is pivotal to retract said needle and wherein said direction of said linear movement is offset from said first axis whereby linear movement of said operating member to control the flow of gas is dependent upon the instantaneous pivotal position of said operating member in controlling the flow of medium.

12. Control means according to claim 2, wherein said spraying apparatus is in the form of an airbrush, said airbrush having a body having first and second ends, said nozzle being mounted to said first end of said body, said airbrush having a transverse through hole and a longitudinal feed passage for medium to be sprayed, the longitudinal feed passage receiving, at one end of said passage, said nozzle, said transverse through hole communicating with said feed passage, being offset from and transverse to the location of said needle, and a plug, said plug being insertable in said transverse through hole selectably to seal a first and a second end of said transverse through hole.

13. An airbrush according to claim 12 wherein said second end of said body has a sealable socket communicating with the longitudinal feed passage, and pipe coupling means in the sealable socket whereto a medium supply pipe may connect.

14. An airbrush according to claim 12 wherein said second end of said body has an air socket, and feed coupling means in the air socket whereto an air feed may be connected.

15. An airbrush according to claim 13 wherein said second end of said body has an air socket, and feed coupling means in the air socket whereto an air feed may be connected and wherein said pipe and feed coupling means comprises a coaxial coupling, whereto a coaxial air- and medium-supply may be connected.

16. An airbrush according to claim 12 wherein said body has a longitudinal vertical mid-plane, a width and a height, said body being symmetrical about said mid-plane with said width being less than said height and wherein said nozzle lies in said vertical mid-plane but is offset from a center line thereof towards a lower part of the body.

* * * * *